US006164585A

United States Patent [19]

Lutz

[11] Patent Number: 6,164,585

[45] Date of Patent: Dec. 26, 2000

[54] ROLL STORAGE APPARATUS

[75] Inventor: Bernhard Lutz, Delbrück, Germany

[73] Assignee: Siemens Nixdorf Informationsystem Aktiengesellschaft, Paderborn, Germany

[21] Appl. No.: 09/214,861

[22] PCT Filed: Jul. 2, 1997

[86] PCT No.: PCT/DE97/01391

§ 371 Date: Jan. 13, 1999

§ 102(e) Date: Jan. 13, 1999

[87] PCT Pub. No.: WO98/05007

PCT Pub. Date: Feb. 5, 1998

[30] Foreign Application Priority Data

Jul. 24, 1996 [DE] Germany ..... 196 29 900

[51] Int. Cl.[7] ..... B65H 39/14; B65H 1/00; B65H 31/04

[52] U.S. Cl. ..... 242/528; 242/534; 271/163; 271/213; 53/204

[58] Field of Search ..... 242/528, 534, 242/534.2, 563, 563.2; 53/204, 409, 587, 588; 271/162, 163, 164, 213

[56] References Cited

FOREIGN PATENT DOCUMENTS 0 290 731 11/1988 European Pat. Off. .
0 735 513 10/1996 European Pat. Off. .

OTHER PUBLICATIONS

IBM Technical Disclosure Bulletin, vol. 12, No. 7, Dec. 1969, pp. 932–933.

*Primary Examiner*—John Q. Nguyen
*Attorney, Agent, or Firm*—Hill & Simpson

[57] ABSTRACT

A roll storage arrangement for sheet-like articles, in particular banknotes, having two roll cores, each of which is connected to a drive whose driving direction can be reversed, and between which a common storage tape can be rereeled. The storage tape is subdivided into logical sectors, which follow one another in the tape longitudinal direction and each accommodate an article to be stored. Arranged between the roll cores is an input/output feed unit, which is optionally adjustable between a rest position and an input/output feed position.

10 Claims, 2 Drawing Sheets

ROLL STORAGE APPARATUS

FIELD OF THE INVENTION

The invention relates to a roll storage arrangement for sheet-like articles, in particular bank notes similar to the

BACKGROUND OF THE INVENTION

At present, two different technical concepts, namely cassette stores and roll stores, are used for storing banknotes in automatic teller machines. In cassette stores, the storage of bank notes takes place in bundle form, each cassette storing one type of note. In the case of a roll store, the storage generally takes place between rolled-up plastic or metal tapes. Here, too, one type of note is stored per roll store, if the roll store is used as a main store. It is also possible for bank notes of a mixed bundle of notes to be stored, if the roll store is used only as an intermediate store, specifically as a so called intermediate cashbox for input banknotes.

When using the two storage technologies in automatic teller machines, in particular in so called automatic recycling machines for a closed circulation of money, one storage medium (cassette or roll) must be present for each type of note to be expected. However, storage media take up a great deal of space and are expensive, so that for the most part a restriction to the most common types of note is carried out.

If notes are accepted or if such are to be output for which there is no storage medium (1000 DM notes, foreign currencies or the like), these are best collected together in automatic recycling machines, but no longer output. In addition, the common factor in the two storage media is that when they are used as a mass store in automatic recycling machines, an intermediate cash box, mentioned above, is always required, since in the event of a paying-in operation being aborted by the customer, it is otherwise not possible to ensure that the already stored banknotes can be output again as they were originally. However, this measure is absolutely necessary, for example as a protection against the laundering of money.

In EP-A-0 735 513, a roll storage arrangement of the type mentioned at the beginning is specified, with which banknotes which have been paid in, even of different currencies or sorts of notes, can be stored in such a way that they can also be output again in a controlled manner at a later time. Two storage coils are provided, between which a storage tape can be wound to and fro as desired. The storage tape is divided into sectors of fixed length, which are identified by a code and hence can be found again at any time. Provided for this purpose is an electronic memory, in which the relationship between the banknotes and the sector codes is stored.

For the purpose of storage in the winding of a storage coil, a banknote is inserted between the storage tape and a second tape. The two tapes, with the banknote lying between them, are then wound up onto a storage coil. In the case of storing a banknote, the second tape is unwound from a separate supply coil, and wound up onto it again in the case of banknotes being removed from the store. The known device is of symmetrical construction, so that each storage coil is assigned a supply coil and a second tape. Three tapes and four coils are therefore necessary. The space requirement and the outlay on drive technology for four coils with a synchronous circumferential speed but to be driven in opposite directions is large. The utilization of the storage volume on the storage coil is also unfavorable, since for each currency note layer, two tape layers are wound up on it. The degree of utilization is reduced still further by the fact that the sector length has to be adapted to the length of the largest banknote occurring.

Therefore, there is a need for a roll storage arrangement of the type mentioned above which ensures a high degree of utilization of the space in the store, with a low outlay in constructional terms on the storage drive.

SUMMARY OF THE INVENTION

According to the present invention, the articles to be stored—hereinafter, the term "banknotes" will be used—are stored between the coil layers of a tape coil formed on the roll cores. It will be noted that the apparatus of the present invention is suitable for sheet-like articles in addition to bank notes and currency. Only a single storage tape is used, that is to say the banknotes are inserted between the coil layers of one and the same storage tape. Differing from the prior art, only two tape coils to be driven in opposite directions are therefore needed. The storage space available on the coils is utilized particularly well, since only one layer of storage tape has to be wound up for each banknote layer. The storage tape itself may comprise two or more part tapes arranged at a distance from one another.

The input/output feed unit has at least one pair of endless belts, which together form a belt gap for the transport of banknotes to be stored, the input/output feed unit being arranged in such a way that, in the rest position of the input/output feed unit, those strands of the endless belts which form the belt gap lie beside the storage belt and in a plane with the latter and, in the input/output feed position, are in each cased pivoted with respect to the plane of the storage tape about a pivot axis that runs through a longitudinal end of the belt gap and lies in the plane of the storage tape. If the storage tape comprises only a single tape, it is expedient to provide a pair of endless belts on each side of said tape. If the storage tape comprises two part tapes, is also possible for a third pair of endless belts to be provided between the two part tapes. As a result, the transport reliability when feeding the banknotes in and out is increased.

In order to accelerate the feeding of banknotes in and out, and hence to reduce the access time to specific banknotes, each tape coil may be assigned an input/output feed unit. This makes it possible for banknotes to be fed in and out, irrespective of the running direction of the storage tape. In the case of a preferred embodiment, however, an input/output feed unit is arranged between the two tape coils in such a way that it is optionally adjustable relative to each of the tape coils into an input/output feed position.

According to an advantageous development of the invention, the sectors are ascertained by measuring the tape lengths that have passed through, given knowledge of the sector length. In this case, the sector length (measured in the tape longitudinal direction) depends on the greatest banknote width, in the case of transverse processing of the banknotes, or on the greatest banknote length, in the case of their longitudinal processing.

In the case of a fixedly predefined sector length, this must correspond to the size of the largest banknote occurring. In the case of currency systems with small banknotes, the degree of utilization of the storage capacity is therefore made worse. According to a development of the invention, therefore, the desired sector length is stored in the control device during an initialization phase of the roll store. The storage capacity of a roll store can thus be matched in each case to the banknote size of a specific currency. It is also possible in this way, in adaptation to the conditions of use, to divide the storage space on site into a plurality of storage regions having sectors of different sizes. For instance, the inner layers of the tape coil may be provided with larger sectors for higher-value banknotes, to be output or put into the store less frequently, these banknotes being larger than those of lower value in most currencies. The remaining storage space can then be provided with smaller sectors.

The subdivision of the storage tape into logical, identifiable sectors permits direct addressing of each individually stored banknote, by stating the length section occupied by it. Provided the banknote can be recognized at all by the automatic machine, the location of the stored banknote, namely the length section identifying its sector, is recorded. The optional engagement or disengagement of the input/output feed unit provides the capability of finding a specific sector on the storage tape in a controlled manner, and of feeding out the banknote stored there. The exact control of the input/output feed unit can be further facilitated if, according to a development of the invention, between the tape coil and the input/output feed unit there is arranged a sensor, which is connected to the control device, to detect the leading and/or trailing edge of the banknotes.

If the inventive roll store is used in an automatic teller machine, it is possible to dispense with the intermediate storage of banknotes paid in. The banknotes can be deposited immediately in the roll store and, if required, identified individually again at any time, collected and output to the customer.

In an embodiment, the present invention provides a roll storage apparatus for sheet-like articles which comprises two opposing roll cores including a first roll core and a second roll core. The first roll core is connected to a first drive motor; the second roll core is connected to a second drive motor. The first and second drive motors are reversible. The first and second roll cores are connected by a common storage tape which is at least partially wound around each roll core with a portion of the storage tape extending between the first and second roll cores and passing through an input/output feed unit. The input/output feed unit comprises a pair of opposing endless belts forming a belt gap disposed therebetween and through which the portion of the storage tape passes. The portion of the storage tape that passes through the belt gap being disposed in a plane. When the input/output feed unit is in a rest position, the endless belts are disposed on lateral opposing sides of the portion of the storage tape and parallel therewith. When the input/output feed unit is in an input/output feed position, the endless belts are pivoted with respect to the plane of the portion of the storage tape and the input/output feed unit is pivoted about a pivot axis that extends through one of the longitudinal ends of the belt gap and in the plane of the portion of the storage tape. The first and second drive motors and the input/output feed unit are all connected to a control device.

In an embodiment, the storage tape is subdivided into a plurality of adjacent logical sectors disposed longitudinally along the tape. Each logical sector accommodates an article to be stored.

In an embodiment, the control device is connected to a measuring device that measures length of storage tape that passes between the two roll cores. The measuring device sends a signal to the control device that indicates the length of the tape that is passed between the roll cores. The control device identifying the logical sector disposed in the belt gap based upon the signal received from the measuring device and the control device moving the input/output feed unit between the rest position and the input/output position in response to the signal received from the measuring device.

In an embodiment, the control unit is connected to a sensor disposed adjacent to the portion of the storage tape and between the input/output feed unit and one of the roll cores. The sensor detects a leading and/or trailing edge of an article passing thereby.

Other objects and advantages of the present invention will become apparent from reading the following detailed description and appended claims, and upon reference to the accompanying drawings.

BRIEF DESCRIPTION OF THE DRAWINGS

The following description explains the invention with reference to exemplary embodiments, in conjunction with the appended drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
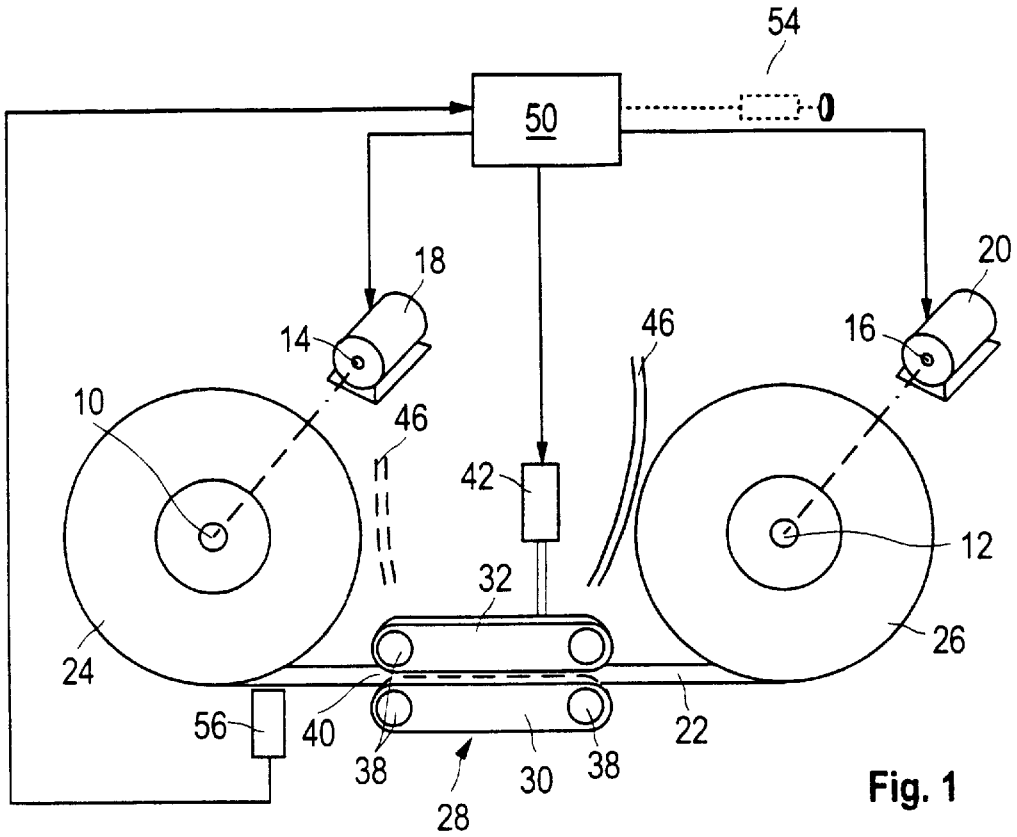
FIG. 1 is a schematic illustration of an inventive storage arrangement with the input/output feed unit in its rest position.
Figure 2:
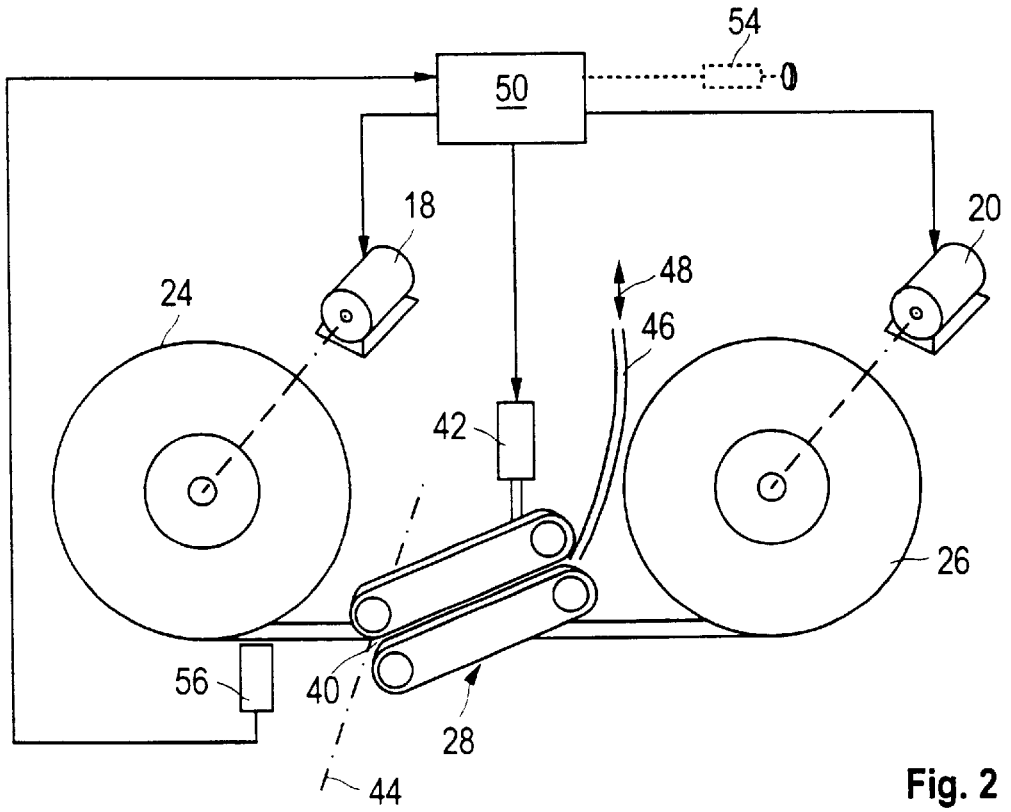
FIG. 2 is a schematic illustration corresponding to FIG. 1 with the input/output feed unit in the input/output feed position.

The roll storage arrangement illustrated in FIGS. 1 and 2 comprises roll cores 10 and 12, which are arranged at a distance from each other and parallel to each other and in each case are coupled to the output shaft 14 or 16 of a reversible-direction motor 18 or 20. Wound up onto the roll cores 10, 12 is a storage tape 22, forming a tape coil 24 or 26, so that a section of the storage tape 22 stretched between the tape coils 24 and 26 remains freely accessible.

Figure 3:
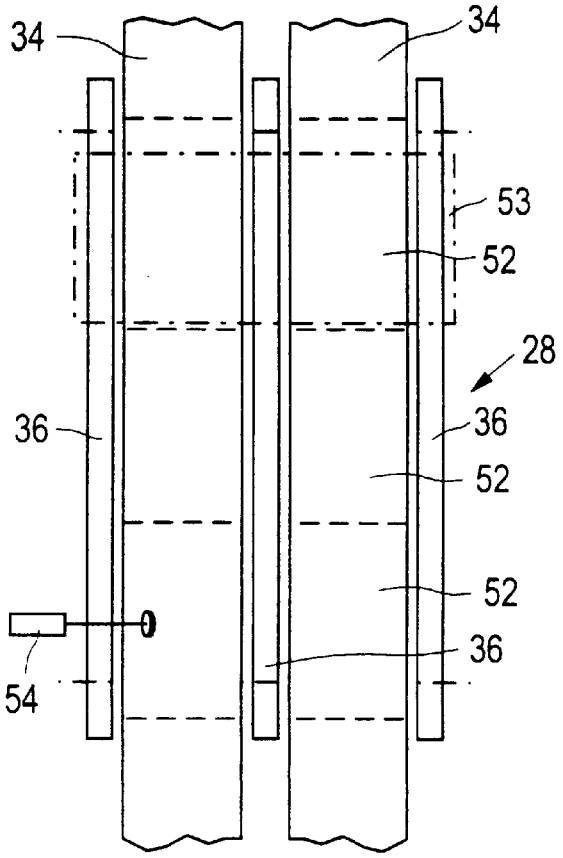
FIG. 3 is a schematic plan view of a section of the storage tape and the lower part of the input/output feed unit and FIG. 4 is a schematic illustration corresponding to FIG. 1 of a modified embodiment of the invention.

Arranged in the region between the two tape coils 24, 26 is an input/output feed unit or loading rocker (designated in general by 28), which comprises a belt group 30 arranged underneath the storage tape 22 and a belt group 32 arranged above the storage tape 22. As FIG. 3 shows, the storage tape 22 comprises two part tapes 34 running parallel to each other in the same plane. Each belt group 30 and 32 comprises three endless belts 36, which are oriented parallel to one another and are guided via mutually coaxial rollers 38 in such a way that one belt strand runs in the plane of the part tapes 34 and parallel to the latter, as FIG. 3 shows. The mutually facing belt strands of the two belt groups 30, 32 cooperate with each other, forming a belt gap 40 for the transport of banknotes. The belt groups 30, 32 are driven at the same advance speed and in the same direction as the storage tape 22.

The loading rocker 28 is adjustable, by means of an adjusting device 42, between a rest position (illustrated in FIG. 1), in which banknotes lying on the storage tape 22 can pass unimpeded through the belt gap, and an input/output feed position (illustrated in FIG. 2), in which the loading rocker 28 is pivoted about a pivot axis 44 (FIG. 2) running through one end of the belt gap 40 and parallel to the axes of the rollers 38, and, in so doing, by way of the end of the belt gap 40 opposite the pivot axis 44, comes into alignment with a track 46, through which the banknotes to be stored can be fed or banknotes to be removed from the store can be discharged, as is indicated by the double arrow 48.

The motors 18, 20 and the adjusting device 42 for adjusting the loading rocker 28 are controlled via a control device 50 of the storage arrangement, which also performs the management of the storage stock.

According to the invention, the storage tape 22 is subdivided in its longitudinal direction into individual sectors 52 (FIG. 3), whose extent in the tape longitudinal direction, given longitudinal processing of the banknotes to be stored, corresponds to the length of the same and, given transverse processing of the banknotes to be stored (banknote 53 in FIG. 3), corresponds to the width of the same. The location of the sectors 52 on the storage tape 22 is ascertained by measuring the tape length that has passed through. Provided for this purpose is a measuring device 54, which is connected to the control device 50. The measuring device 54 is fitted to the loading rocker 28. In order to sense the leading and trailing edge of the banknotes, a sensor 56 is arranged close to the storage tape 22 and to the pivot axis 44 of the loading rocker 28, and is likewise connected to the control device 50. With the aid of this sensor 56, exact, tape-synchronized control of the adjusting device 42 of the loading rocker 28 is further facilitated. Hence, each sector 52 can be identified uniquely by directly selecting the sector on the basis of a specific tape length section, and brought into a position relative to the loading rocker 28, in which position the latter is able to deposit a banknote on the selected sector of the storage tape or to remove a banknote from the relevant sector. The assignment of individual banknotes and the corresponding sectors in which they are kept is in this case performed by the memory management means accommodated in the control device 50.

In the case of using an above described storage arrangement in automatic paying-in and dispensing teller machines, in which it is intended that banknotes paid in should also be output again to different customers (automatic recycling machines), all the notes recognized by the note acceptor (that is to say even foreign currencies), can be accepted and output. All that is necessary is for each note accepted to be allocated a corresponding free sector 52 of the storage tape in an electronic memory of the control device. The stock management of the automatic machine registers the type of note and tape sector. During the paying-out operation, a sector is selected which is filled with a note of the desired amount. This note is fed out and paid out via the loading rocker 28. If an abort operation takes place during paying in, it is necessary for the banknotes already paid in up to the abortion to be given back to the customer again as they were originally. Hitherto, an intermediate store was needed for this. However, since in the case of the inventive storage arrangement the storage spaces of the individual banknotes can be found uniquely, it is possible to dispense with an intermediate store.

A further advantage of the inventive solution resides in the fact that the access times to the store can also be optimized by means of appropriate selection, in that, for example, types of note which are seldom used are stored in sectors at the ends of the tape, whereas the more common and frequently needed types of note are stored at the center of the tape, where faster access can take place. By identifying the sectors using the tape length section occupied by them, it also becomes possible, using pure control means, to select the sectors to be of different sizes, depending on the use and/or the currencies to be stored.

In the case of the embodiment of the storage arrangement illustrated in FIGS. 1 to 2, the storage, that is to say the deposition of the banknotes on the storage tape 22, takes place while the latter is running from the tape coil 26 onto the tape coil 24, that is say from right to left in the figures. The removal of banknotes can take place when the tape is running in the opposite direction. If, then, the banknotes sought are stored in the coil 26, they would first have to be transported through the loading rocker 28 to the tape coil 24 and then fed out in the opposite direction. This means a loss of time. It is therefore expedient to mount the loading rocker 28 and to construct the adjusting device 24 in such a way that the loading rocker 28 can be brought, in relation to each tape coil 24 and 26, into an input/output feed position, so that banknotes can be fed in and out in either running direction of the storage tape 22. In addition to the appropriate mounting of the loading rocker 28, a second track 46 for feeding the banknotes and transporting them away is then also required, as is indicated with dashed lines in FIG. 1.

Figure 4:
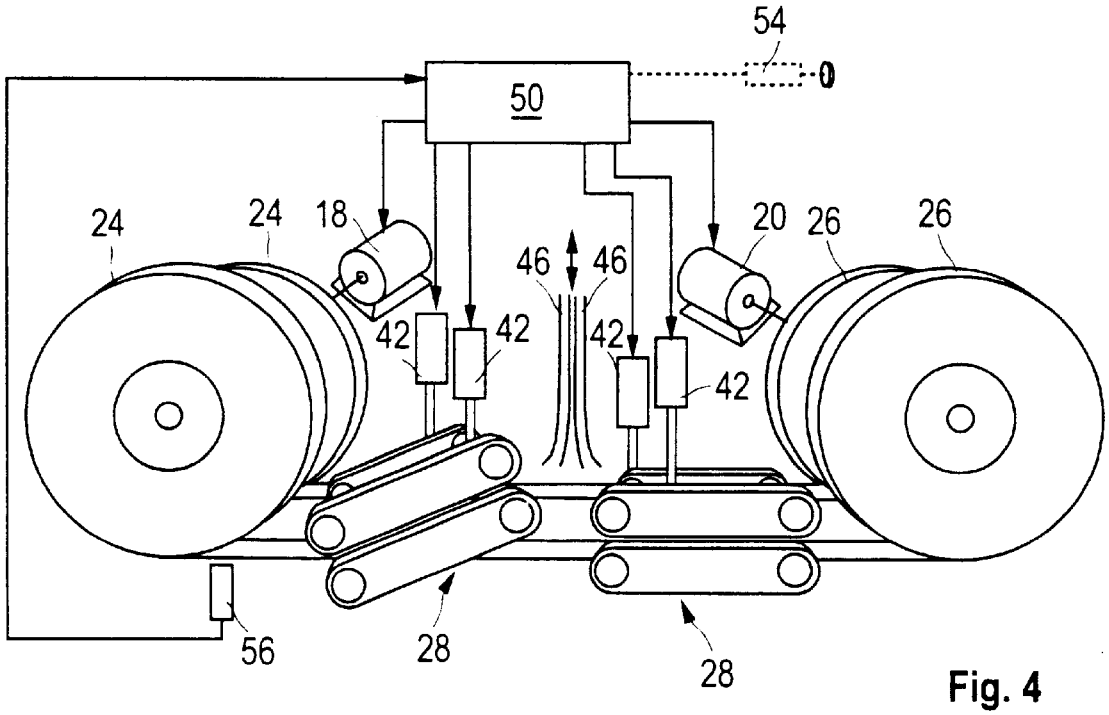

Another, more complicated possibility is shown by FIG. 4. In the case of the storage arrangement illustrated schematically there, identical parts are again provided with identical reference symbols. FIG. 4 shows a storage arrangement, each tape coil being assigned a loading rocker. Furthermore, FIG. 4 shows that a plurality of the storage arrangements illustrated in FIGS. 1 and 2 can be arranged alongside one another, in order to increase the overall storage capacity. In this case, it is possible to drive the mutually coaxial roll cores via a common motor, or else individually.

In the case of the exemplary embodiments illustrated above, a single storage tape (even if comprising the part tapes 34 under certain circumstances) was used, the banknotes being clamped between the individual coil layers of the storage tape 22.

Instead of a separate motor 14, 16 for each roll core 10 and 12, it is also possible to provide a single motor, which drives the belt groups 30, 32 and the storage tape 22 running through between these. The roll cores 10, 12 can then be coupled to this motor via a slipping clutch.

It goes without saying that the roll storage arrangement described above is suitable not only for banknotes but generally for sheet-like articles.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A roll storage apparatus for sheet-like articles comprising:

two opposing roll cores including a first roll core and a second roll core, the first roll core being connected to a first drive motor, the second roll core being connected to a second drive motor, the first and second drive motors being reversible, the first and second roll cores being connected by a common storage tape which is at least partially wound around each roll core with a portion of the storage tape extending between the first and second roll cores and passing through an input/output feed unit, the input/output feed unit comprising a pair of opposing endless belts forming a belt gap disposed therebetween and through which the portion of the storage tape passes, the portion of the storage tape that passes through the belt gap being disposed in a plane, the belt gap having two opposing longitudinal ends, when the input/output feed unit is in a rest position, the endless belts are disposed on lateral opposing sides of the portion of the storage tape and parallel therewith, when the input/output feed unit is in an input/output feed position, the endless belts are pivoted with respect to the plane of the portion of the storage tape and the input/output feed unit being pivoted about a pivot axis extending through one of the longitudinal ends of the belt gap and in the plane of the portion of the storage tape, the first and second drive motors and the input/output feed unit each being connected to a control device, the storage tape being subdivided into plurality adjacent logical sectors disposed longitudinally along the tape, each logical sector for accommodating an article to be stored, the control device being connected to a measuring device for measuring lengths of the storage tape passing between the roll cores, the measuring device sending a signal to the control device indicating the length of tape that has passed between the roll cores, the control device identifying the logical sector disposed in the belt gap based upon the signal received from the measuring device and the control device moving input/output feed unit between the rest position and the input/output position in response to the signal received from the measuring device.

2. The roll storage apparatus of claim 1 wherein the belt gap having a first longitudinal end and a second longitudinal end, the first longitudinal end being disposed between the first roll core and the second longitudinal end, the second longitudinal end being disposed between the second roll core and the first longitudinal end, when the input/output feed unit is in a first input/output feed position, the endless belts are pivoted with respect to the plane of the portion of the storage tape and the input/output feed unit being pivoted about a first pivot axis extending through the first longitudinal end of the belt gap and in the plane of the portion of the storage tape, and when the input/output feed unit is in a second input/output feed position, the endless belts are pivoted with respect to the plane of the portion of the storage tape and the input/output feed unit being pivoted about a second pivot axis extending through the second longitudinal end of the belt gap and in the plane of the portion of the storage tape.

3. The roll storage apparatus of claim 1 wherein the control unit is connected to a sensor disposed adjacent to the portion of the storage tape and between the input/output feed unit and one of the roll cores, the sensor for detecting a leading and/or trailing edge of an article passing thereby.

4. A roll storage apparatus for banknotes comprising:

two opposing roll cores including a first roll core and a second roll core, the first roll core being connected to a first drive motor, the second roll core being connected to a second drive motor, the first and second drive motors being reversible, the first and second roll cores being connected by a common storage tape which is at least partially wound around each roll core with a portion of the storage tape extending between the first and second roll cores and passing through an input/output feed unit, the input/output feed unit comprising a pair of opposing endless belts forming a belt gap disposed therebetween and through which the portion of the storage tape passes, the portion of the storage tape that passes through the belt gap being disposed in a plane, the belt gap having two opposing longitudinal ends, when the input/output feed unit is in a rest position, the endless belts are disposed on lateral opposing sides of the portion of the storage tape and parallel therewith, when the input/output feed unit is in an input/output feed position, the endless belts are pivoted with respect to the plane of the portion of the storage tape and the input/output feed unit being pivoted about a pivot axis extending through one of the longitudinal ends of the belt gap and in the plane of the portion of the storage tape, the first and second drive motors and the input/output feed unit each being connected to a control device, the storage tape being subdivided into plurality adjacent logical sectors disposed longitudinally along the tape, each logical sector for accommodating a banknote to be stored, the control device being connected to a measuring device for measuring lengths of the storage tape passing between the roll cores, the measuring device sending a signal to the control device indicating the length of tape that has passed between the roll cores, the control device identifying the logical sector disposed in the belt gap based upon the signal received from the measuring device and the control device moving input/output feed unit between the rest position and the input/output position in response to the signal received from the measuring device, the control unit also being connected to a sensor disposed adjacent to the portion of the storage tape and between the input/output feed unit and one of the roll cores, the sensor for detecting a leading and/or trailing edge of a banknote passing thereby.

5. The apparatus of claim 4 wherein the belt gap having a first longitudinal end and a second longitudinal end, the first longitudinal end being disposed between the first roll core and the second longitudinal end, the second longitudinal end being disposed between the second roll core and the first longitudinal end, when the input/output feed unit is in a first input/output feed position, the endless belts are pivoted with respect to the plane of the portion of the storage tape and the input/output feed unit being pivoted about a first pivot axis extending through the first longitudinal end of the belt gap and in the plane of the portion of the storage tape, and when the input/output feed unit is in a second input/output feed position, the endless belts are pivoted with respect to the plane of the portion of the storage tape and the input/output feed unit being pivoted about a second pivot axis extending through the second longitudinal end of the belt gap and in the plane of the portion of the storage tape.

6. A roll storage apparatus for sheet-like articles comprising:

two opposing roll cores including a first roll core and a second roll core, the first roll core being connected to a first drive motor, the second roll core being connected to a second drive motor, the first and second drive motors being reversible, the first and second roll cores being connected by a common storage tape which is at least partially wound around each roll core with a portion of the storage tape extending between the first and second roll cores and passing through an input/output feed unit, the input/output feed unit comprising a pair of opposing endless belts forming a belt gap disposed therebetween and through which the portion of the storage tape passes, the portion of the storage tape that passes through the belt gap being disposed in a plane, the belt gap having two opposing longitudinal ends, when the input/output feed unit is in a rest position, the endless belts are disposed on lateral opposing sides of the portion of the storage tape and parallel therewith, when the input/output feed unit is in an input/output feed position, the endless belts are pivoted with respect to the plane of the portion of the storage tape and the input/output feed unit being pivoted about a pivot axis extending through one of the longitudinal ends of the belt gap and in the plane of the portion of the storage tape, the first and second drive motors and the input/output feed unit each being connected to a control device.

7. The roll storage apparatus of claim 6 wherein the belt gap having a first longitudinal end and a second longitudinal end, the first longitudinal end being disposed between the first roll core and the second longitudinal end, the second longitudinal end being disposed between the second roll core and the first longitudinal end, when the input/output feed unit is in a first input/output feed position, the endless belts are pivoted with respect to the plane of the portion of the storage tape and the input/output feed unit being pivoted about a first pivot axis extending through the first longitudinal end of the belt gap and in the plane of the portion of the storage tape, and when the input/output feed unit is in a second input/output feed position, the endless belts are pivoted with respect to the plane of the portion of the storage tape and the input/output feed unit being pivoted about a second pivot axis extending through the second longitudinal end of the belt gap and in the plane of the portion of the storage tape.

8. The roll storage apparatus of claim 6 wherein the storage tape is subdivided into plurality adjacent logical sectors disposed longitudinally along the storage tape, each logical sector for accommodating an article to be stored.

9. The roll storage apparatus of claim 8 wherein the control device is connected to a measuring device that measures lengths of the storage tape passing between the roll cores, the measuring device sending a signal to the control device indicating the length of tape that has passed between the roll cores, the control device identifying the logical sector disposed in the belt gap based upon the signal received from the measuring device and the control device moving input/output feed unit between the rest position and the input/output position in response to the signal received from the measuring device.

10. The roll storage apparatus of claim 6 wherein the control unit is connected to a sensor disposed adjacent to the portion of the storage tape and between the input/output feed unit and one of the roll cores, the sensor for detecting a leading and/or trailing edge of an article passing thereby.

* * * * *